US009055847B1

(12) United States Patent
Flannery et al.

(10) Patent No.: US 9,055,847 B1
(45) Date of Patent: Jun. 16, 2015

(54) FLEXIBLE FOLDING INFANT BATHER

(75) Inventors: Mark A. Flannery, Longboat Key, FL (US); Porter R. Million, Chaska, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 13/370,780

(22) Filed: Feb. 10, 2012

Related U.S. Application Data

(60) Provisional application No. 61/442,193, filed on Feb. 12, 2011.

(51) Int. Cl.

| | |
|---|---|
| ***A47K 3/064*** | (2006.01) |
| ***A47C 4/28*** | (2006.01) |
| ***A47D 9/00*** | (2006.01) |
| ***A47K 3/03*** | (2006.01) |

(52) U.S. Cl.
CPC ..... *A47K 3/064* (2013.01); *A47C 4/283* (2013.01); *A47D 9/005* (2013.01); *A47K 3/03* (2013.01)

(58) Field of Classification Search
USPC ..... 4/586, 587, 589, 590, 585, 546; 220/9.1–9.4; 297/56, 45; 248/165, 166, 248/150, 164; 5/655, 101, 102
See application file for complete search history.

(56) References Cited

U.S. PATENT DOCUMENTS

| | | | | | |
|---|---|---|---|---|---|
| 22,733 | A | * | 1/1859 | Karshner | 607/85 |
| 1,327,866 | A | * | 1/1920 | Hagstrom | 4/586 |
| 1,726,752 | A | * | 9/1929 | Mirkin | 4/551 |
| 1,750,698 | A | * | 3/1930 | Abbott | 4/551 |
| 1,799,029 | A | * | 3/1931 | Smith | 297/36 |
| 2,089,801 | A | * | 8/1937 | Kennedy | 4/572.1 |
| 2,096,237 | A | * | 10/1937 | Frey | 297/45 |
| 2,281,629 | A | * | 5/1942 | Snow | 5/655 |
| 2,513,457 | A | * | 7/1950 | De Puy | 4/586 |
| 2,745,181 | A | * | 5/1956 | Czerniewicz | 33/27.03 |
| 2,916,744 | A | * | 12/1959 | May et al. | 5/102 |
| 3,004,793 | A | * | 10/1961 | Loomis | 297/274 |
| 3,557,392 | A | * | 1/1971 | Schmidt | 4/547 |
| 4,245,850 | A | * | 1/1981 | Boudreau | 280/87.051 |
| 5,276,926 | A | * | 1/1994 | Lopez | 4/568 |
| 5,361,430 | A | * | 11/1994 | Wise | 4/572.1 |
| 5,460,430 | A | * | 10/1995 | Miga et al. | 297/452.13 |
| 5,617,594 | A | * | 4/1997 | Chien | 5/102 |
| 5,809,588 | A | * | 9/1998 | Angelotti | 4/587 |
| 6,341,816 | B1 | * | 1/2002 | Chen et al. | 297/16.1 |
| 6,434,768 | B2 | * | 8/2002 | Brown et al. | 5/99.1 |
| 6,594,840 | B2 | * | 7/2003 | Tomas et al. | 5/655 |
| 7,856,678 | B2 | * | 12/2010 | Thorne et al. | 4/572.1 |
| 2011/0148155 | A1 | * | 6/2011 | Chapman et al. | 297/16.1 |

* cited by examiner

*Primary Examiner* — Paul R Durand
*Assistant Examiner* — Erin Deery

(57) ABSTRACT

An infant bather having a flexible water bath supported by a frame. The frame has a scissors fold such that the flexible water bath folds one way to an open configuration for bathing an infant and folds the other way to a closed configuration for storage.

14 Claims, 11 Drawing Sheets

FLEXIBLE FOLDING INFANT BATHER

This application claims the benefit under 35 U.S.C. 119(e) of U.S. Provisional Application No. 61/442,193 filed Feb. 12, 2011, which provisional application is hereby incorporated by reference in its entirety into this application.

FIELD OF THE INVENTION

The present invention relates generally to an infant bather, particularly to an infant bather that has a bath that is flexible, and specifically to a flexible infant bather that folds out for use and folds in to a compact configuration for storage.

BACKGROUND OF THE INVENTION

The term "bath" may mean a container for water or other cleansing liquid. For example, the source Dictionary.com, unabridged (based on the Random House Dictionary, © Random House, Inc. 2011) defines "bath" as follows:

1. a washing or immersion of something, esp. the body, in water, steam, etc., as for cleansing or Medical treatment: I take a bath every day. Give the dog a bath.
2. a quantity of water or other liquid used for this purpose: running a bath.
3. a container for water or other cleansing liquid, as a bathtub.
4. a room equipped for bathing; bathroom: The house has two baths.
5. a building containing rooms or apartments with equipment for bathing; bathhouse.
6. Often, baths. One of the elaborate bathing establishments of the ancients: the baths of Caracalla.
7. Usually, baths. A town or resort visited for medical treatment by bathing or the like; spa.
8. a preparation, as an acid solution, in which something is immersed.
9. the container for such a preparation.
10. a device for controlling the temperature of something by the use of a surrounding medium, as sand, water, oil, etc.

SUMMARY OF THE INVENTION

A feature of the present invention is the provision in an infant bather, of a flexible water bath.

Another feature of the present invention is the provision in an infant bather, of a flexible water bath having a back section, a butt section, and a leg section, of the back section being greater in length than the leg section, and of the leg section being inclined at an angle greater than the back section such that the infant may be bathed in a comfortable position with his or her head out of the water.

Another feature of the present invention is the provision in an infant bather, of a frame for a water bath, of the frame having a scissors fold such that the frame is foldable out to an open configuration and foldable in to a closed or stored configuration.

Another feature of the present invention is the provision in an infant bather, of a frame for a water bath, of the frame having a pair of support members, of each of the support members having upper and lower sections, of the upper sections of the support members confronting each other when the infant bather is in a closed configuration, of the lower sections of the support members confronting each other when the infant bather is in the closed configuration, and of one upper section of one support member confronting the lower section of the other support member when the infant bather is in the open configuration.

Another feature of the present invention is the provision in an infant bather, of a frame for a water bath, of the frame having a pair of support members, of each of the support members being elongate and endless, and of each of the support members passing through the other of the support members in a looped fashion.

Another feature of the present invention is the provision in an infant bather, of a frame for a water bath, of the frame having a pair of support members, of a pivot housing for the support members, and of a seat on the pivot housing for seating of the support members when the frame is in an open configuration to minimize an unintended closing of the frame from the open configuration.

Another feature of the present invention is the provision in an infant bather, of a frame for a water bath, of the frame having a pair of support members, of a pivot housing for the support members, of a seat on the pivot housing for seating of the support members when the frame is in an open configuration to minimize an unintended closing of the frame from the open configuration, and of the seat including a ridge that forces the swinging support members to pop out of a plane just prior to engagement into the seat such that a user is notified by feel or by a clicking that the support members have been engaged into the seat.

An advantage of the present invention is a safe infant bather. One feature contributing to this advantage is the scissors fold arrangement to the frame. The flexible water bath opens as the scissors frame folds open, and the flexible water bath functions as one stop that prevents the frame from further opening. Another feature contributing to a safe infant bather is a first pivot housing on one end of the infant bather having a stop molded therein for stopping pivoting of a first support member, and a second pivot housing on the other end of the infant bather having a stop molded therein for stopping pivoting of a second support member. Another feature contributing to a safe infant bather is a seat into which the support members snap upon attaining the open configuration, which seat also minimizes an unintended closing of the frame from the open configuration. Another feature contributing to a safe infant bather is the layout of the flexible water bath that provides back, butt and leg sections shaped for the size of an infant to minimize movement of the infant as well as to provide comfort for the infant and to keep the head of the infant out of the water. Another feature contributing to a safe infant bather is the set of four feet engaged to the folding frame to provide stability to the infant bather.

Another advantage of the present invention is that the infant bather as a whole folds relatively flat to a closed configuration for storage to occupy a minimum amount of space.

Another advantage of the present invention is that the flexible water bath of the infant bather folds to a fully open position in which the whole of the infant's body, except the head, may be immersed in water.

Another advantage of the present invention is that the flexible water bath has a unique shape or configuration that is in the form of a seat so as to keep the infant in a seated position to keep the child more comfortable and less afraid of water and to free the hands of the caregiver, one of which in a conventional bath is usually tucked behind the head or neck of an infant to keep the infant's head out of water. The flexible water bath has a back section that is oblique to the lower horizontally running sections that engage the feet that make contact with the surface on which the infant bather rests.

Another advantage of the present invention is that the flexible water bath has a unique shape or configuration that minimizes the amount of water used for the bath. Since the flexible water bath has defined back, butt and leg sections, and since the flexible water bath narrows from the head (or shoulder) end to the foot end, the infant conforms to the infant bath and thus displaces a great amount of space, thereby requiring less water to surround the torso and legs of the infant.

Another advantage of the present invention is that the infant bather is inexpensive and easy to manufacture.

Another advantage of the present invention is that pinch points are minimized. One feature contributing to this advantage is that the frame does not fold completely scissors wise, but stops short of a complete scissors fold by the feet of the support members making contact with each other, thereby minimizing any scissors pinch.

DESCRIPTION

Figure 1:
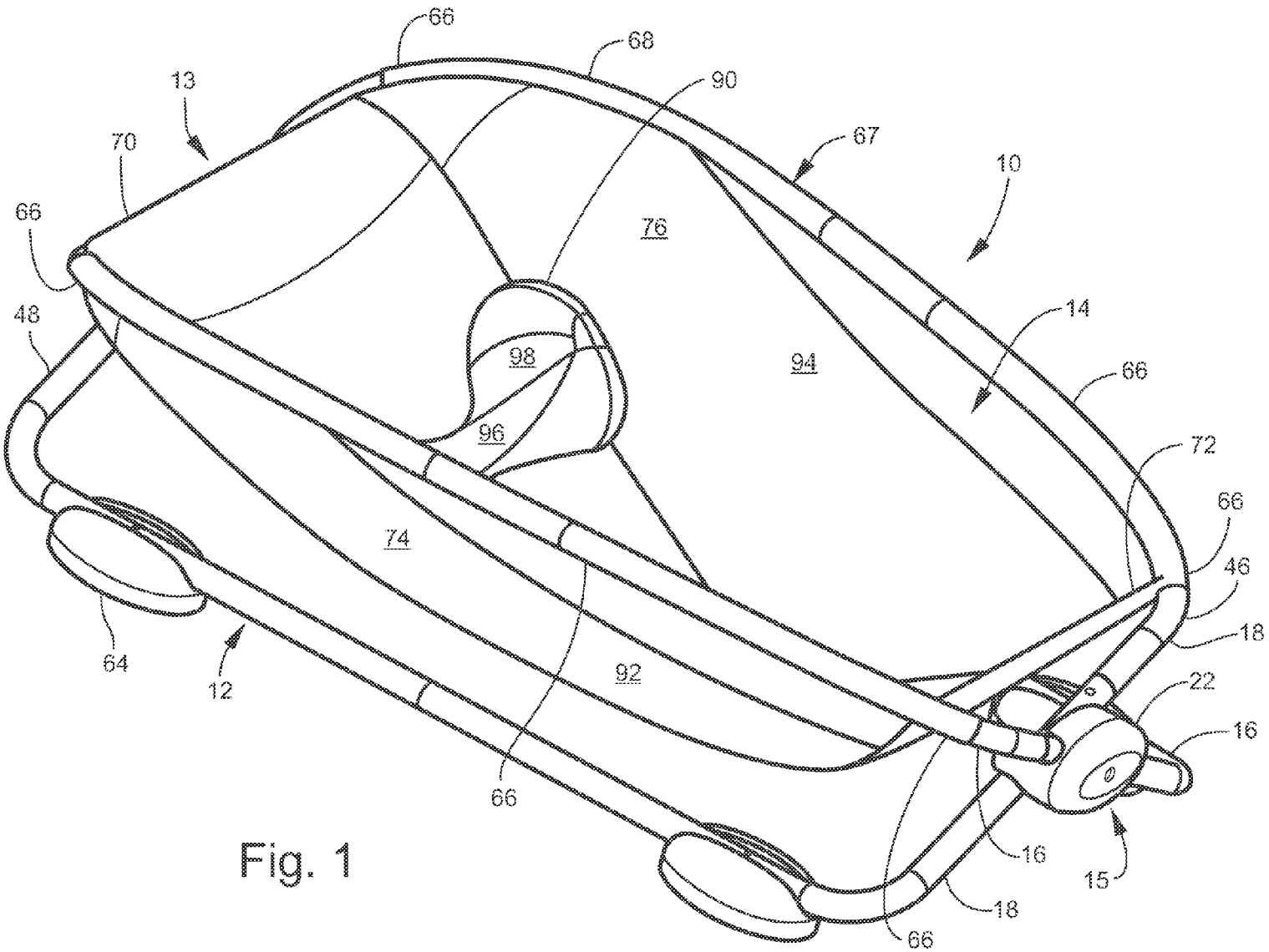
FIG. 1 is a perspective view of the present flexible folding infant bather.
Figure 2:
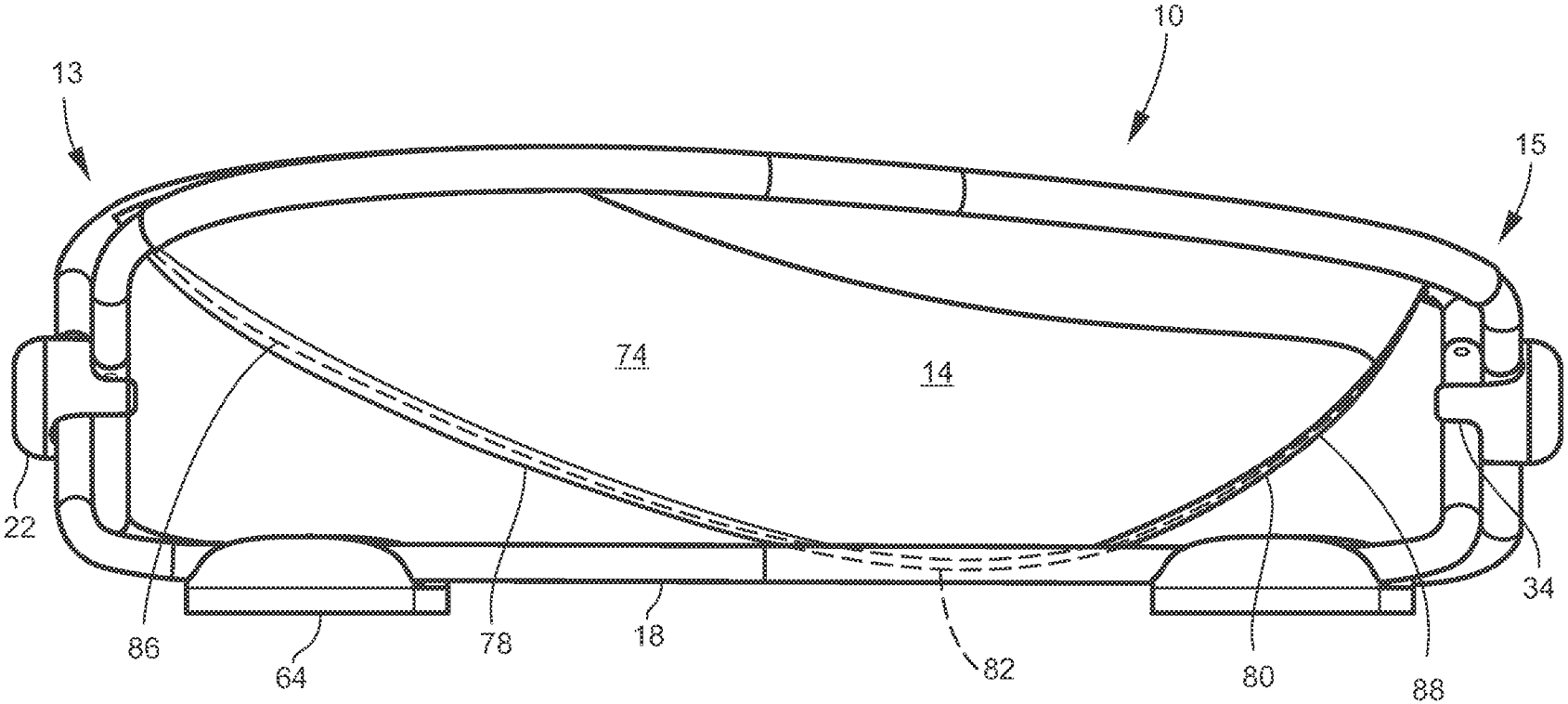
FIG. 2 is a right side view of the infant bather of FIG. 1.
Figure 3:
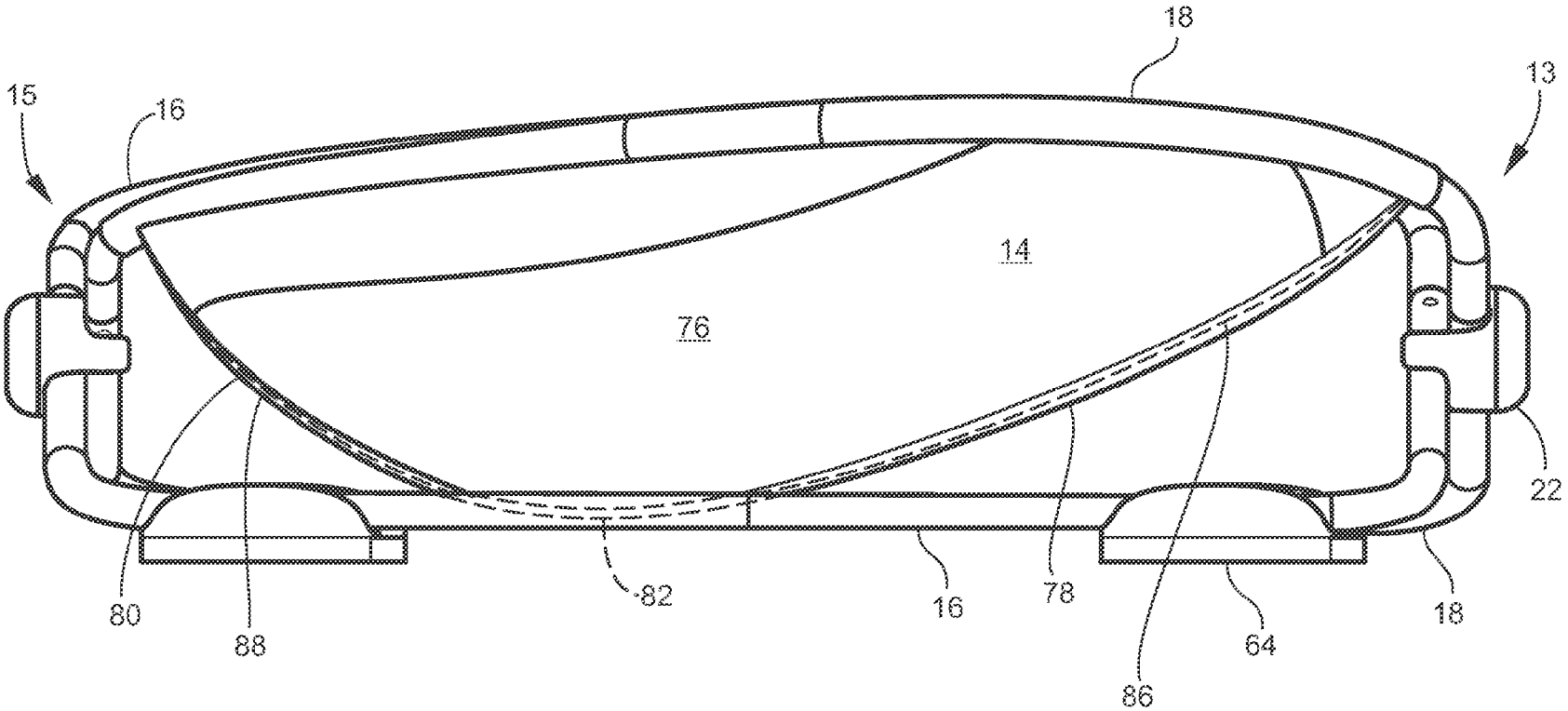
FIG. 3 is a left side view of the infant bather of FIG. 1.
Figure 4:
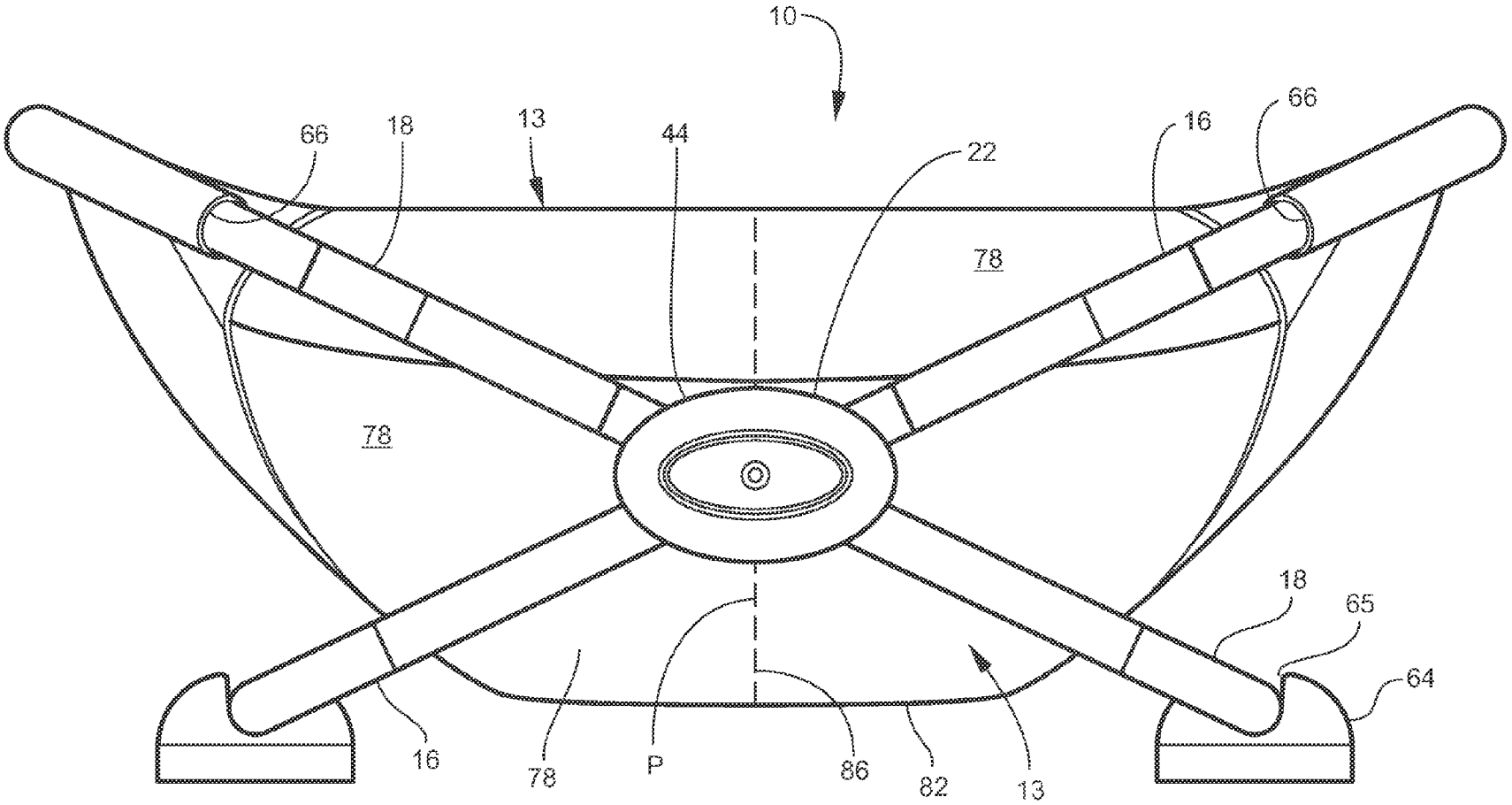
FIG. 4 is an end view of the head end of the infant bather of FIG. 1.
Figure 5:
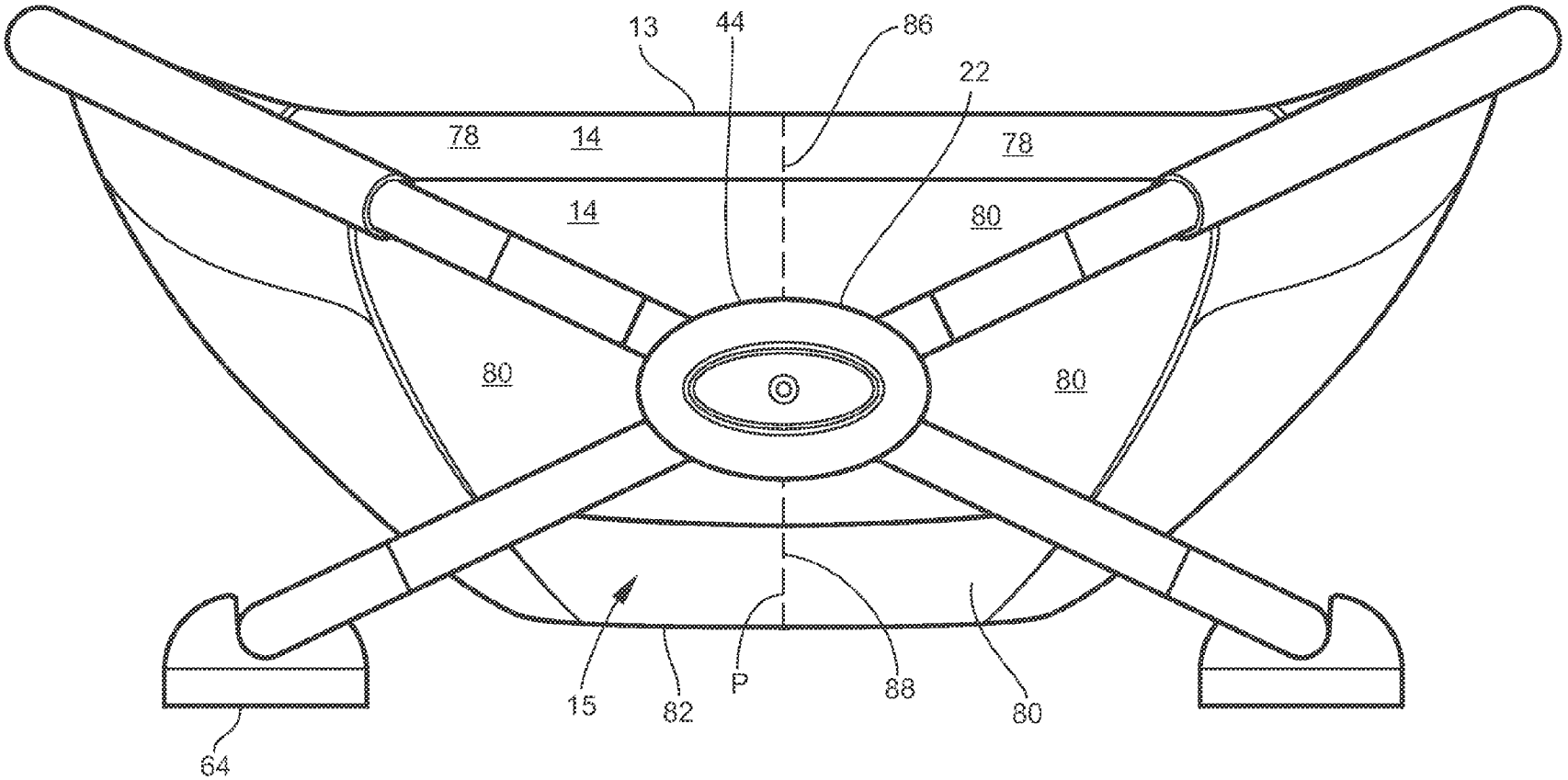
FIG. 5 is an end view of the foot end of the infant bather of FIG. 1.

The present flexible folding infant bather is shown in FIG. 1 and is indicated by reference number 10. Infant bather 10 generally includes a frame 12 and a flexible infant bath 14. Infant bather 10 further includes a head end 13 and a foot end 15.

Figure 10:
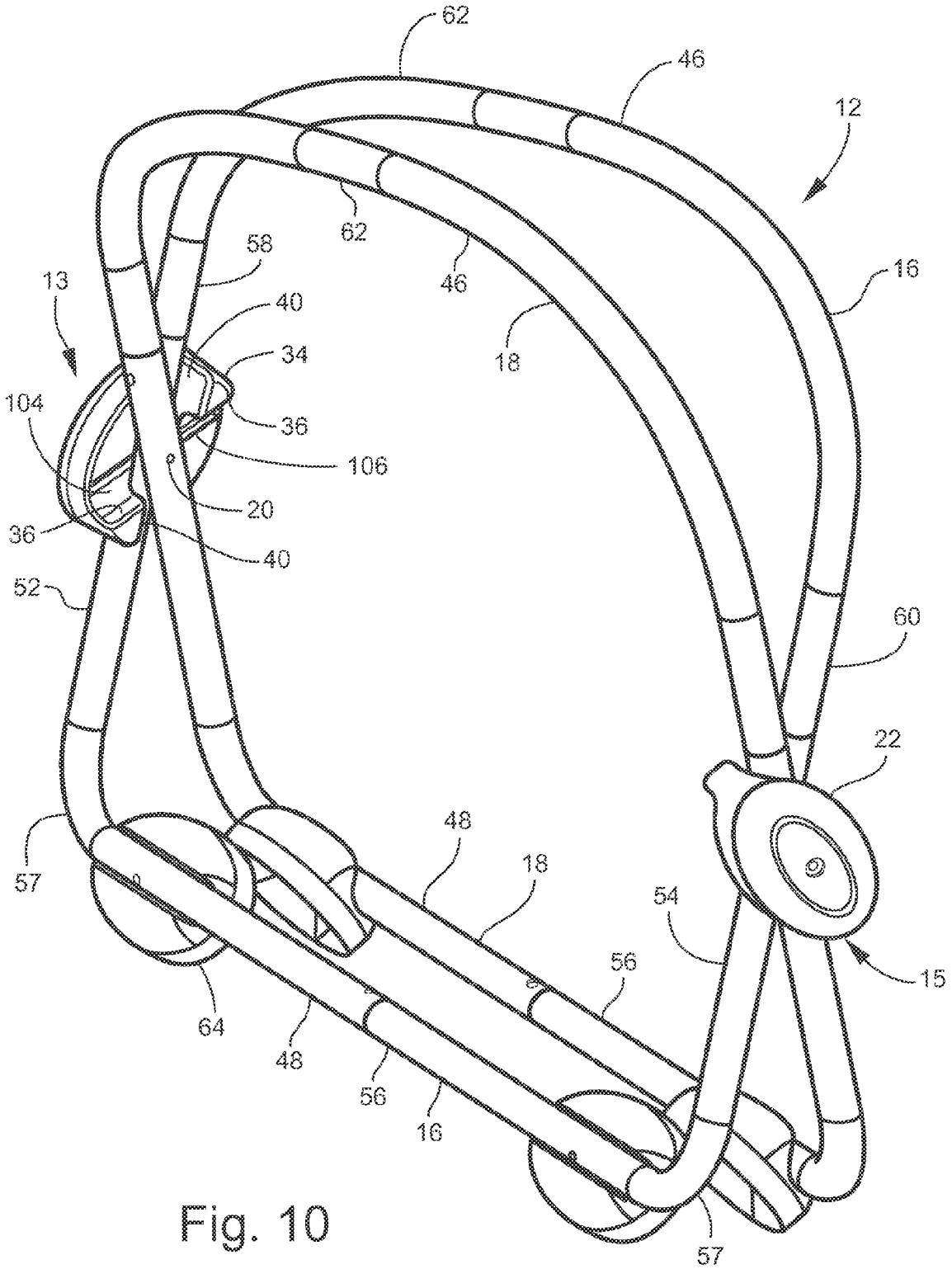
FIG. 10 is a perspective view of the infant bather of FIG. 1 in a collapsed or closed configuration.

Frame 12 includes an open configuration as shown in FIG. 1 and a closed configuration shown in FIG. 10. Frame 12 is pivotably foldable between the open and closed configuration.

Frame 12 includes a first support member 16 and a second support member 18. Each of the support members 16 and 18 is elongate and endless. Each of the support members 16 and 18 forms a loop.

Support member 16 is pivotally engaged to support member 18 through a pin 20 engaged in a pivot housing 22. Pivot housing 22 includes a molded piece or hub or disk shaped block or main body 23 having a cylindrical channel 24 formed therein for receiving and engaging one of the support members 16, 18. Cylindrical channel 24 runs diametrically through the pivot block 23. Cylindrical channel 24 includes an open face 26 such that, during manufacture, support member 16 or 18 may be dropped into or snapped into channel 24.

Pivot block 23 includes a front end 28, a rear end 30, and a circular sidewall 32 between the front and rear ends 28, 30. Cylindrical channel 24 runs from a portion of sidewall 32 to another portion of sidewall 32 and is open on the rear end 38.

Pivot block 22 includes a pair of stops 34 projecting longitudinally from the rear end 30 such that the stops 34 project transversely over one of the support members 16, 18. Stops 34 are positioned diametrically opposite each other. Each of the stops 34 includes a first stop face 36. First stop face 36 includes a right angle portion disposed at a right angle relative to a rear face 38 of the rear end 30 of the pivot block 23. The right angle portions of the first stop faces 36 are disposed parallel to each other. First stop faces 36 include cylindrical seat portions that engage the same straight support member 16 or 18 from opposite sides of such support member.

Figure 9:
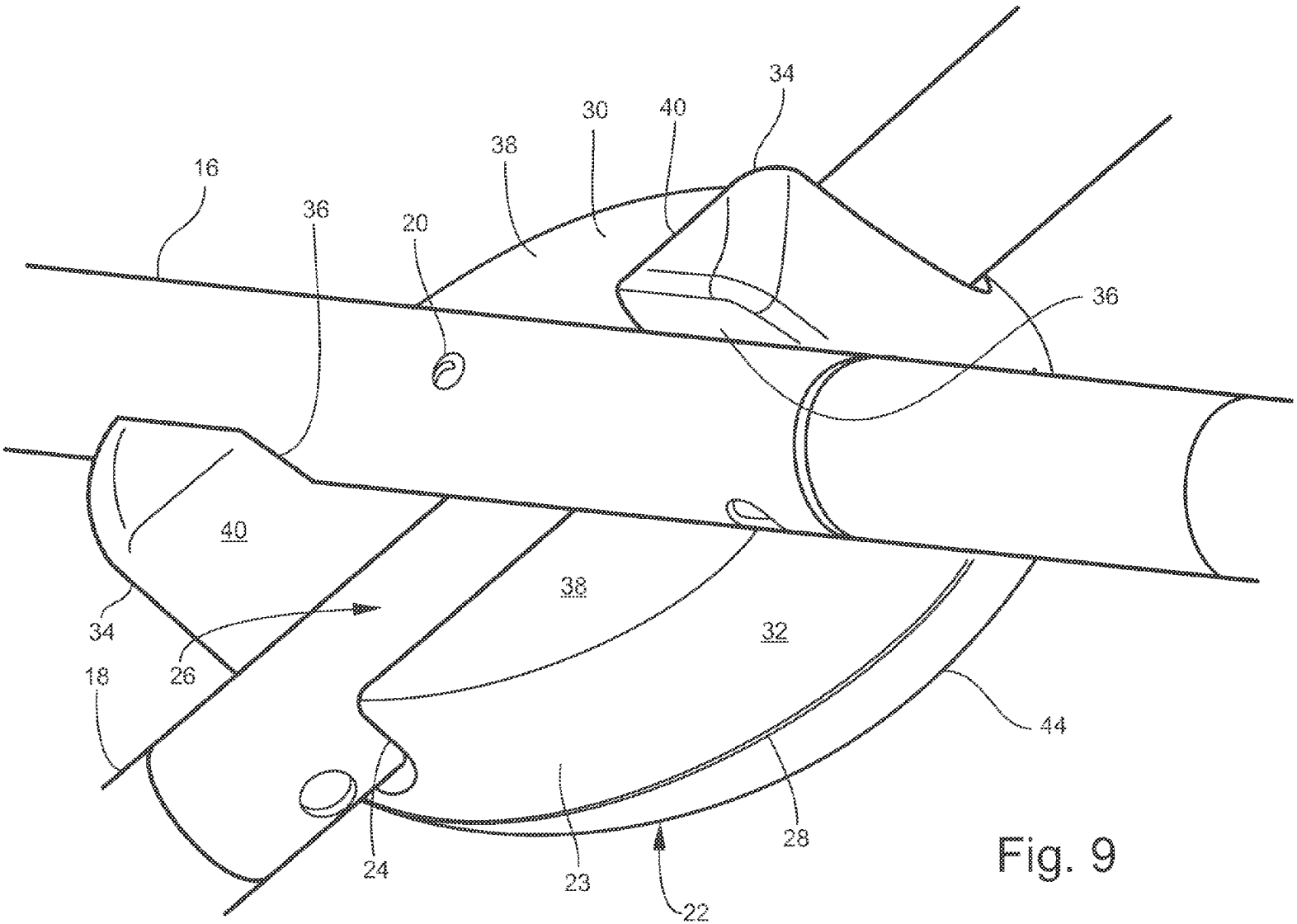
FIG. 9 is a perspective detail view of the pivot housing of the present infant bather, where infant bather is in the open configuration of FIG. 1.

Each of the stops 34 includes a guide face 40. Guide face 40 is disposed at a right angle relative to rear face 38 of the rear end 30 of pivot block 23. Guide face 40 is disposed obliquely relative to the first stop face 36 on the same stop 34. Guide faces 40 are disposed parallel to each other. The purpose of guide face 40 is to guide the placement of a support member, such as support member 18 in FIG. 9, into channel 24. Unless feet 64 are eliminated, guide face 40 is not a stop face, as shown in FIG. 10.

In section, stop 34 is generally triangular. First stop face 36 makes generally up a first side of a triangle where such first side includes a right angle portion and a cylindrical seat portion, guide face 40 makes up a second side of the triangle, and a portion of circular sidewall 32 makes up a third side of the triangle.

Relative to one pivot housing 22, pivot pin 20 extends from an inner side of support member 16, through support member 16, to and through support member 18, and is then anchored in pivot block 23. Relative to the other pivot housing 22, pivot pin 20 extends from an inner side of support member 18, through support member 18, to and through support member 16, and is then anchored in pivot block 23.

In the open configuration shown in FIG. 1, stop faces 36, especially the cylindrical seat portions thereof, are employed to engage support member 16 (or support member 18 on the other pivot housing 22). In the open configuration, support members 16, 18 cross each other at a relatively great angle.

In the closed configuration shown in FIG. 10, the support members 16, 18 stop pivoting short of guide faces 40 (support member 16 stops short of guide faces 40 on one pivot housing 22 and support member 18 stops short of the guide faces 40 on the other pivot housing 22). In the closed configuration, support members 16, 18 cross each other at a relatively small angle at the pivot housings 22, whereas, as indicated above, in the open configuration support members 16, 18 cross each other at a relatively great angles at the pivot housings 22. In the closed configuration, feet 64 on support member 16 make contact with feet 64 on the other support member 18 and this contact stops a pivoting of the lower sections 48 toward each other.

When support member 16 (or support member 18) is pivoted relative to the pivot housing 22, a face of support member 16 may confront and make contact with rear face 38 of rear end 30 of pivot block 23. A washer may be engaged on pivot pin 20 between support members 16 and 18.

Stops 34 are integral with pivot block 23. A cap 44 is disposed on the front end 28 of pivot block 23 to visually hide the mountains and valleys on the molded pivot block 23. Cap 44 further hides and minimizes tampering of the outer end of pivot pin 20.

Each of the support members 16, 18 is preferably a tube formed of a metal or plastic. Metal is preferred. If members 16, 18 are formed of a metal, a nonrust metal such as aluminum or stainless steel is preferred. Each of the support members 16, 18 may be a rod that is solid through the cross-section of the rod.

Figure 8:
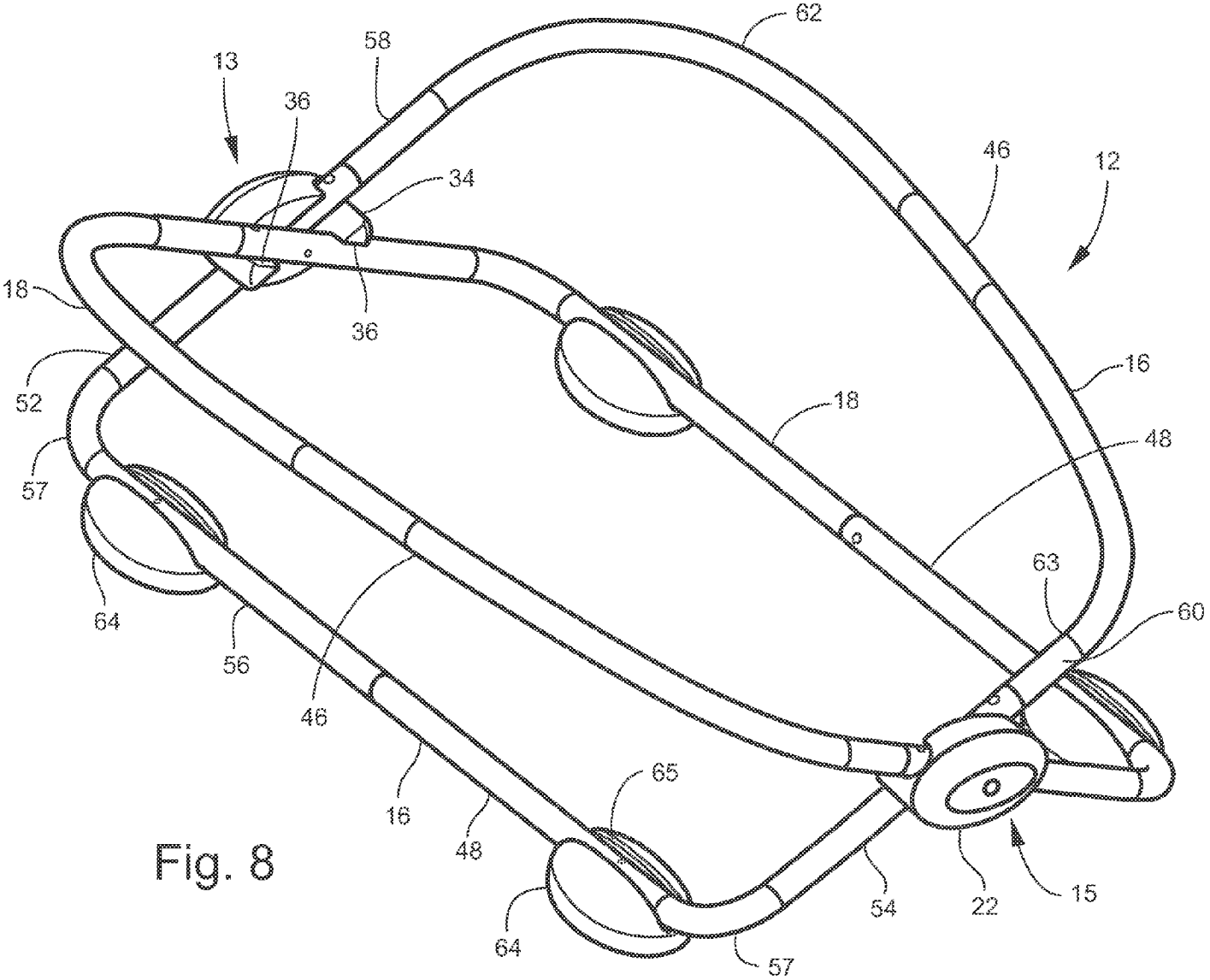
FIG. 8 is a perspective view of the frame of the infant bather of FIG. 1.

As shown in FIG. 8, each of the support members 16, 18 includes an upper section 46 and a lower section 48. By definition, the location at which the upper section 46 meets the lower section 48 is at the pivot pin 20. In the open configuration shown in FIG. 8, the upper section 46 of one support member 16 or 18 confronts the lower section 48 of another support member 16 or 18. In the closed configuration shown in FIG. 10, the upper sections 46 of the support members 16, 18 confront each other and the lower sections 48 of the support members 16, 18 confront each other.

Lower section 48 is U-shaped and includes generally three portions. First and second portions 52, 54 are straight, run parallel to each other and run downwardly from the pivot housings 22. Third portion or lower horizontally running section 56 is straight and runs between the first and second portions 52, 54. First portions 52, 54 are joined to third portion 56 by a rounded corner junction 57. Lower section 48 is a symmetrically shaped U-shaped section of a support member.

Upper section 46 is U-shaped and includes generally three portions. First and second portions 58, 60 are straight, run parallel to each other, and run upwardly from the pivot housings 22. Third portion 62 is generally J-shaped or C-shaped. Upper section 46 is a nonsymmetrically shaped U-shaped section of a support member. Upper section 46 is generally the shape of an ear.

Upper sections 46 in combination (upper section 46 of support member 16 and upper section 46 of support member 18) form a shape that is relatively flat at the foot end 15 (defined by portions 54 and 60), then tapers outwardly from the foot end 15 to a point about three-fourths of the way to the head end 13 (defined by portions 52, 58), whereupon at the three-fourths location the shape formed by the upper sections 46 in combination begins to taper inwardly toward the head end 13 (defined by portions 52, 58). The point that is about three-fourths of the distance from the foot end 15 to the head end 13 is a point on an axis defined by pivot pins 20, which pivot pins 20 are coaxial. The shape defined by the upper sections 46 in combination is relatively flat at the head end 13.

In other words, each of the upper sections 46 tapers outwardly relative to the axis defined by the pivot pins 20 prior to tapering back toward the axis defined by the pivot pins 20. Such tapering begins at substantially a junction 63 (shown in FIG. 8) between portion 60 and the third portion 62 of respective support member 16 or 18. Such tapering continues on third portion 62 outwardly past points that are one-fourth, one-third, one-half, and two-thirds of the way from the foot end 15 to the head end 13. Such tapering continues outwardly on third portion 62 to a point that is about three-fourths of the way from the foot end 15 to the head end 13, whereupon third portion 62 begins to taper toward the pivot pin axis and toward the respective portion 58. The shape formed by the upper sections 46 in combination is generally an apple or butterfly shape.

In yet other words, at a point that is three-fourths of the way from the foot end 15 to the head end 13, a spacing between sections 46 is greater than at a point that is two-thirds of the way from the foot end 15 to the head end 13. Also, at a point that is two-thirds of the way from the foot end 15 to the head end 13, a spacing between sections 46 is greater than at a point that is one-half of the way from the foot end 15 to the head end 13. Also, at a point that is one-half of the way from the foot end 15 to the head end 13, a spacing between sections 46 is greater than at a point that is one-third of the way from the foot end 15 to the head end 13. Also, at a point that is one-third of the way from the foot end 15 to the head end 13, a spacing between sections 46 is greater than at a point that is one-fourth of the way from the foot end 15 to the head end 13. These relationships are true for each of the open and closed configurations of the frame 12.

Support member 16 is elongate and endless. Support member 18 is elongate and endless. In the pivot housing 22 at the head end 13, support member 16 is engaged in the channel 24 and support member 18 is engaged by the stops 34 and seats 104. In the pivot housing 22 at the foot end 15, support member 16 is engaged by the stops 34 and seats 104 and support member 18 is engaged by the channel 24. In other words, support member 16 passes through a loop formed by support member 18. Also, support member 18 passes through a loop formed by support member 16.

In one of the pivot housings 22, one support member 16 or 18 is fixed (in channel 24) and nonrotatable in such pivot housing 22 and the other support member 16 or 18 is pivotable relative to such pivot housing 22 while still being engaged to such pivot housing 22. In the other of the pivot housings 22, the other of the support members 16, 18 is fixed (in channel 24) and nonrotatable in such pivot housing 22 and the other of the support members 16, 18 is pivotable relative to such pivot housing 22 while still being engaged to such pivot housing 22.

Frame 12 is mounted on a set of four feet 64. Each foot 64 includes a channel 65 formed therein and running longitudinally. Straight third portion 56 of lower section 48 is set in the channel 65 and is connected with a pin connector, such as a rivet, to the foot 64. Foot 64 is elliptical in shape. An endless sidewall of foot 64 is generally formed in the shape of an ellipse. The undersurface of foot 64 can be roughened so as to be nonslip. Foot 64 can be formed of an elastomer or rubber or rubber like material so as to minimize slippage on a number of surfaces such as a ceramic (for instance, porcelain), wood, plastic, or metal.

Flexible infant bath 14 is engaged between the upper sections 46 of the support members 16, 18. Flexible infant bath 14 is a receptacle, container, bowl, bathtub, or basin that holds water, that seats or cradles an infant, and that is flexible.

Flexible infant bath 14 can be or include a leakproof flexible material that is leakproof as to water.

Flexible infant bath 14 can be or include a material that is resistant to, and can be easily cleaned of, soap, shampoo and other cleansing fluids and solid.

Flexible infant bath 14 can be or include a material that is resistant to, and can be easily cleaned of, bodily waste such as urine and feces.

Flexible infant bath 14 can be or include a flexible plastic material such as a polyamide. Polyamides include nylons.

Flexible infant bath 14 can be or include a natural or synthetic fabric (such as nylon) that is laminated to or coated with a leakproofing or waterproofing material such as rubber, a plastic, a polymer, polyvinyl chloride, polyurethane, a silicone elastomer, a fluoropolymer, or a wax.

Flexible infant bath 14 can be or include a polyurethane coated nylon.

Flexible infant bath 14 can be or include a ripstop nylon. Ripstop nylon is a light-weight nylon fabric with inter-woven ripstop reinforcement threads in a crosshatch pattern. Ripstop nylon can be a material that is woven with coarse, strong warp and filling yarns spaced at intervals so that tears will not spread. Ripstop nylon can be waterproof, water resistant, and fire resistant, and can have zero porosity (will not allow air or water through). Ripstop nylon can be soft and silk like.

Flexible infant bath 14 can be or include a material that has zero porosity to water and/or air, with such materials including rubber, a plastic, a polymer, polyvinyl chloride, a polyurethane, a silicone elastomer, a fluoropolymer, a polyamide, a nylon, a ripstop nylon, a polyester, a natural textile treated with a resin, and a synthetic textile treated with a resin.

Flexible infant bath 14 can be or include a skin friendly soft and flexible waterproof material such as a polyamide, a ripstop nylon, a natural textile coated with a resin, or a synthetic textile material.

Flexible infant bath 14 can be or include a laminate having a skin friendly material on the inner side that makes contact with the skin of an infant. The skin friendly material may be ripstop nylon that is soft and silk like or a natural or synthetic fabric or textile.

Flexible infant bath 14 can be or include a laminate having a durable material on the outer or underside that does not make contact with the skin of an infant when the infant is in the bath 14. The durable material may be or include polyurethane, polyester, nylon, a vulcanized rubber, neoprene, vinyl chloride, or synthetic leather.

Flexible infant bath 14 can be or include a vulcanized rubber or laminated layers of nylon and butyl rubber.

Flexible infant bath 14 can be or include a material that does not stretch under the weight of an infant or stretches to a minimum degree.

Flexible infant bath 14 can be or include a synthetic rubber such as neoprene or a foamed neoprene.

Flexible infant bath 14 can be or include a hybrid of neoprene and foam rubber.

Flexible infant bath 14 can be or include a rubberized stockinette or a dipped pure latex material or an all-rubber material or a pure natural rubber material.

Flexible infant bath 14 can be or include an impervious stockinette. An impervious stockinette has an inner layer made of polyester and an outer layer made of an impervious rubber material.

Flexible infant bath 14 can be or include an uncoated ripstop nylon, or an impregnated ripstop nylon such as a silicone impregnated ripstop nylon, or a polyurethane or urethane coated nylon such as a polyurethane coated ripstop nylon, or a silicone coated nylon such as a silicone coated ripstop nylon.

Flexible infant bath 14 may be or include a polyester or a vinyl laminated polyester or a vinyl coated polyester or a neoprene coated nylon, or a vinyl coated yarn or vinyl coated natural fabric.

Flexible infant bath 14 can be a waterproof, moisture-vapor permeable, unitary (non-laminated and single thickness) sheet material.

Flexible infant bath 14 can be a laminate.

Flexible infant bath 14 can be or include a material that is resistant to dirt, mildew, oil and salt and will not tear, stretch, crack, rot or mildew. One such material is a vinyl coated polyester.

Flexible infant bath 14 can be or include cotton that is treated with a polymer or resin to make it substantially waterproof.

Flexible infant bath 14 can be or include a waterproof/breathable fabric or material. A waterproof/breathable fabric or material is a fabric or material that resists liquid water passing through, but allows water vapor to pass through. Water resistance or the degree to which a fabric or material is water proof can be measured by the amount of water, in mm, which can be suspended above the fabric or material before water seeps through. Breathability can be measured by the rate at which water vapor passes through, in grams of water vapor per square meter of fabric or material per 24 hour period (g/m2/d). For the purposes herein, "waterproof/breathable" requires the fabric or material to withstand over 1,000 millimeters of water (9.8 kPa) pressure without leaking.

Flexible infant bath 14 can be waterproofed by a spray.

Flexible infant bath 14 can be a waterproof fabric or material that includes insulation on the upper side of the bath 14 or on the underside of the bath 14.

Flexible infant bath 14 can be a) a laminate or b) a non-laminate structure formed of a single piece.

Flexible infant bath 14 can be or include a flexible textile cloth or a knit fabric. The textile cloth or knit fabric may be treated with a waterproof resin.

Flexible infant bath 14 can be or include a vinyl chloride, polyurethane, nylon, and/or polyethylene.

Flexible infant bath 14 can be or include a vinyl chloride, polyurethane, nylon, or polyethylene where the vinyl chloride, polyurethane, nylon, or polyethylene is treated with a waterproof resin.

Flexible infant bath 14 can be or include a material made of one or more of a flexible textile cloth, a knit fabric, cotton, a vinyl chloride, polyurethane, nylon, polyethylene, polyester, a waterproof resin, a material that provides both a waterproof property and a moisture permeable property, a leather, and a synthetic leather.

Flexible infant bath 14 includes a pair of sleeves 66 that engage one respective upper section 46. More particularly, sleeve 66 may engage at least some or all of the third J-shaped portion 62 of the upper section 46. Sleeve 66 may also engage some of first and second portions 58, 60. Preferably, at least a portion of first and second portions 58, 60 remains unengaged or free of the sleeves 66.

Figure 6:
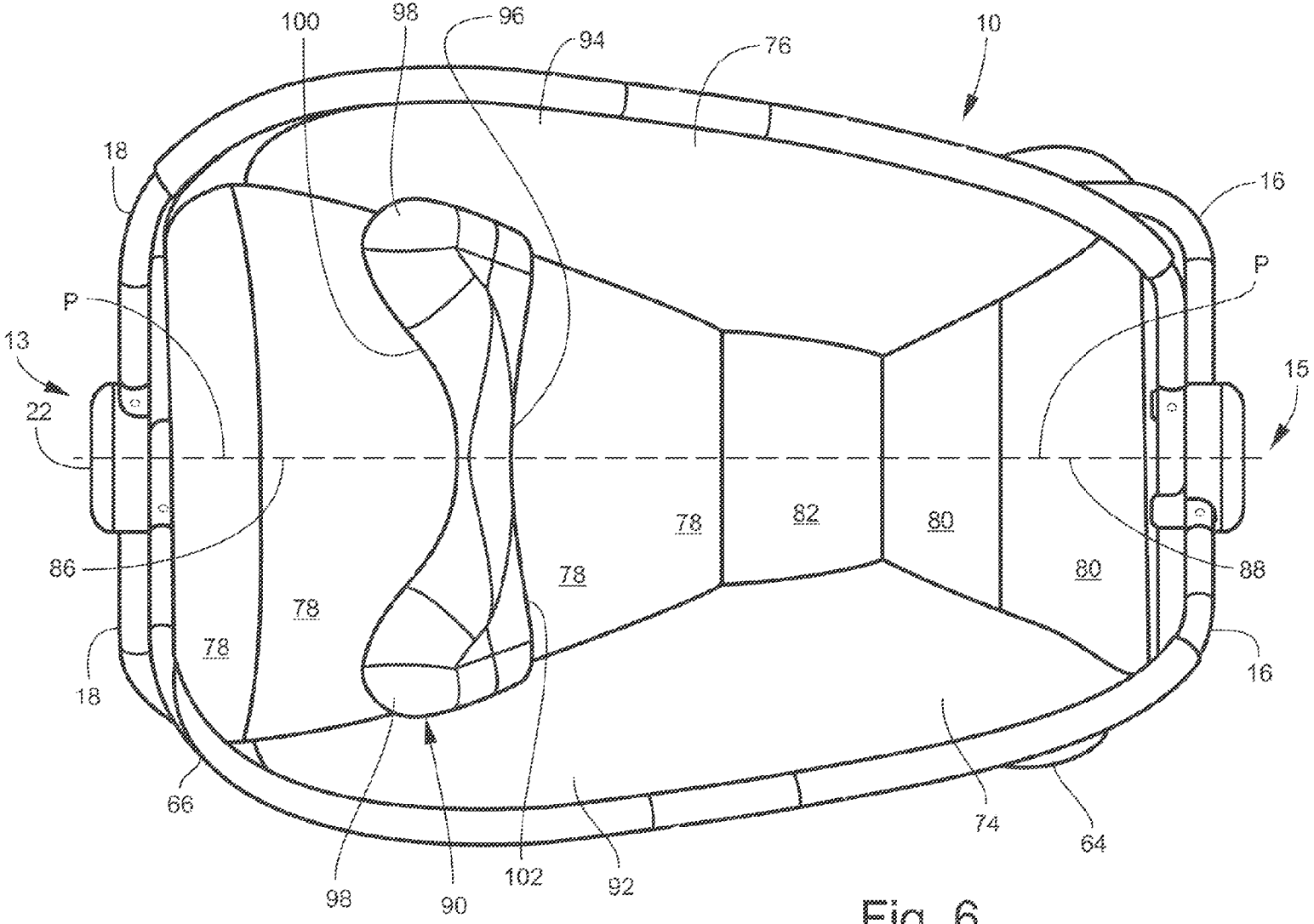
FIG. 6 is a top view of the infant bather of FIG. 1.
Figure 7:
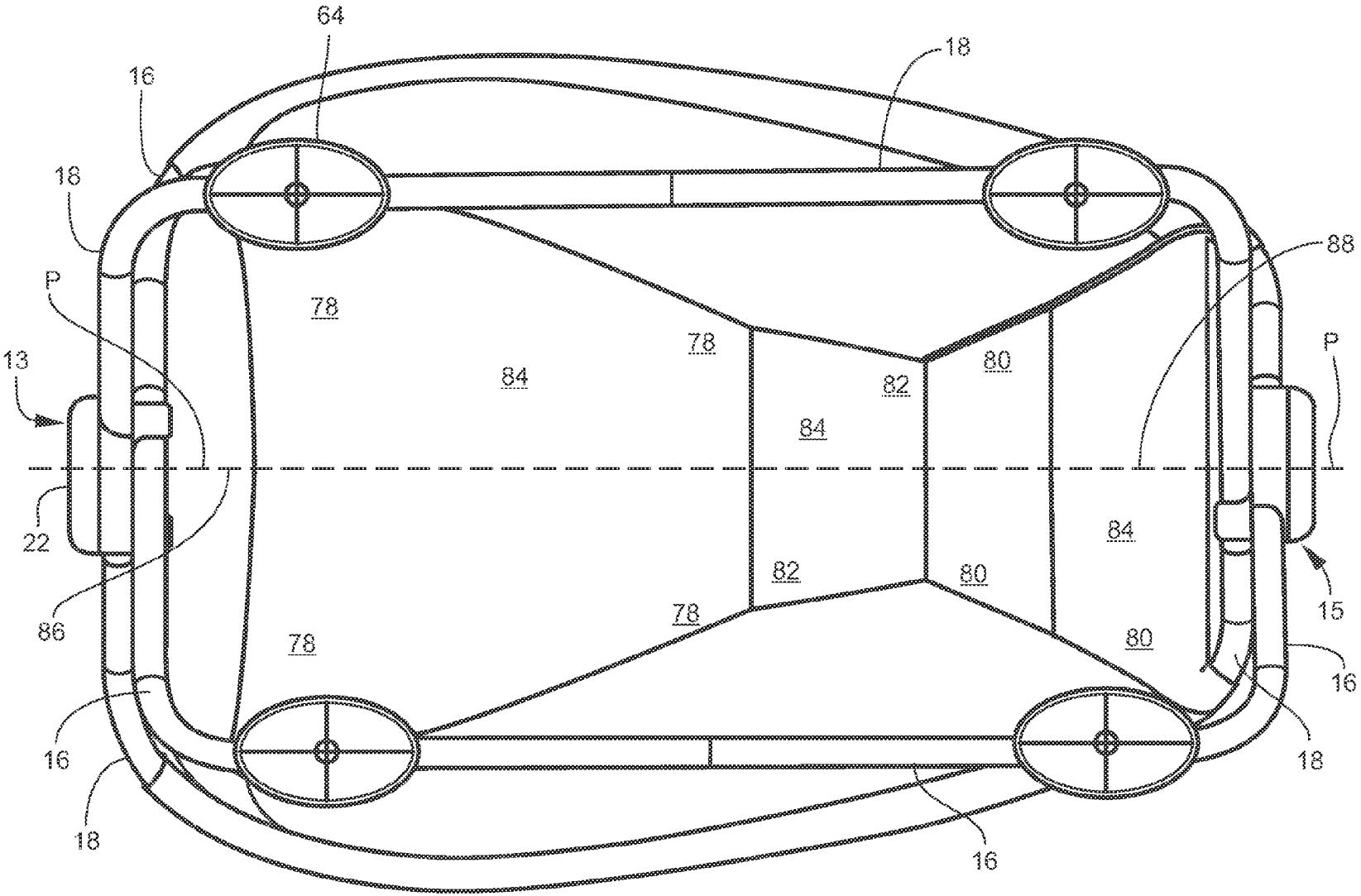
FIG. 7 is a bottom view of the infant bather of FIG. 1.

From the top view shown in FIG. 6, it can be appreciated that a perimeter 67 of the infant bath 14 generally follows the shape of the combination of the upper sections 46. In other words, the perimeter of the infant bath 14 includes a pair of curved edges 68. Curved edge 68 is on and runs the length of sleeve 66. Curved edge 68 is an engaged curved edge. The perimeter 67 further includes a pair of unengaged or free edges 70, 72. Unengaged edge 70 runs adjacent to head end 13 and confronts portions 58 of the upper sections 46. Unengaged edge 72 runs adjacent to foot end 15 and confronts portions 60 of the upper sections 46. Edges 70, 72 run parallel to each other.

Infant bath 14 includes a right half-section 74 and a left half-section 76. A vertical longitudinal plane P splits or defines the right and left half-sections 74, 76 and runs through the head and foot ends 13, 15. In the open configuration of FIG. 1, right half-section 74 is spaced apart from left half-section 76. In the closed configuration of FIG. 10 where the flexible infant bath 14 is not shown, the right half-section 74 would confront the left half-section 76.

Infant bath 14 further includes a back section 78 adjacent the head end 13 of the infant bather 10, a leg section 80 adjacent the foot end 15 of the infant bather 10, and a butt section 82 between the back and leg sections 78, 80 of the flexible water bath 14.

Infant bath 14 further includes an underside 84. The underside 84 on the vertical longitudinal plane P has a first length along the back section 78 and a second length along the leg section 80. The first length along the back section 78 is greater than the second length along the leg section 80. The underside 84 on the vertical longitudinal plane P along the leg section 80 includes an inclination. The underside on the vertical longitudinal plane P along said back section 78 includes an inclination. The inclination along the leg section 80 is greater than the inclination along the back section 78. The inclination along the back section 78 grows greater from the butt section 82 to the head end 13 such that the back section 78 is curved along line 86. The inclination along the leg section 80 grows greater from the butt section 82 to the foot end 15 such that the leg section 80 is curved along line 88.

In other words, slopes on the leg section 80 are greater than slopes on the back section 78 where such slopes of the back and leg sections 78, 80 are taken at identical heights, where the underside 84 on the vertical longitudinal plane P has a first length along the back section 78 and a second length along the leg section 80, and where the first length along the back section 78 is greater than the second length along the leg section 80.

The slope or gradient of a straight or curved line describes its steepness, incline, or grade. A higher slope value indicates a steeper incline. In the case of a curved line specifically, the slope is a value taken at a point tangential to the curved line. The underside 84 on the vertical longitudinal plane P is curved from the butt section 82 to the head end 13 along a curved line 86. The underside 84 on the vertical longitudinal plane P is curved from the butt section 82 to the head end 13 along a curved line 88. Since lines 86 and 88 are curved, a slope is a value taken at a point. A point on curved line 88 has a greater slope than a point on curved line 86 where the points are at identical heights or at identical distances from an axis of straight third portion 56.

The slope of curved line 86 increases from the butt section 82 to the head end 13. The slope of curved line 88 increases from the butt section 82 to foot end 15. The rate of increase of the slope of curved line 88 from butt section 82 to foot end 15 is greater than the rate of increase of the slope of curved line 86 from butt section 82 to head end 13.

The back section 78 of the flexible water bath 14 is oblique to the lower horizontally running sections 56 that engage the feet 64 that make contact with a surface on which the infant bather 10 rests. When a straight line is drawn from the end of the butt section 82 to the free edge 70, such straight line is at a substantial angle, such as between about 20 and 60 degrees, relative to the horizontal and to the lower horizontally running sections 56.

From sleeves 66 or curved edges 68, the flexible infant bath 14 tapers inwardly and downwardly until where the right half-section 74 meets the left half-section 76 at the vertical longitudinal plane P. From unengaged edge 70 running near head end 13, the flexible infant bath 14 tapers inwardly and downwardly to the butt section 82. From unengaged edge 72, the flexible infant bath 14 tapers inwardly and downwardly to the butt section 82.

Bath 14 includes a head rest or pillow 90. Head rest 90 is formed inside of the bath 14 on the back section 78 and extends to and between right and left portions 92, 94 of the bath 14. Head rest 90 protrudes upwardly from the back section 78.

Head rest 90 includes a neck portion 96 interconnecting two head support portions 98. Neck portion 96 is of a height (distance from back section 78) less than the height of the head support portions 98. Neck portion 96 is of a thickness (distance along the direction from the butt section 82 to the head end 13) less than the thickness of head support portion 98. Head rest 90 may be formed of the same material or of a different material than the infant bath 14.

Head rest 90 is generally the shape of a bone. Head rest 90 includes a U-shaped upper surface 100 running from the upper side of one head support portion 98, over the upper side of the neck portion 96, and onto the upper side of the other head support portion 98. Head rest 90 includes, opposite of the U-shaped upper surface 100, an inverted U-shaped lower surface 102 having a relatively shallow U-shaped curve in relation to U-shaped curved surface 100. Surface 102 runs from the underside of one head support portion 98, over the underside of the neck portion 96, and onto the underside of the other head support portion 98.

Head rest 90 cradles an infant's head, whose neck muscles are often weak or undeveloped such that the head of the infant will tend to drop to the front or to the side.

Head rest 90 can be an inflatable pillow. Head rest 90 can be filled with a resilient material such as foam.

Figure 11:
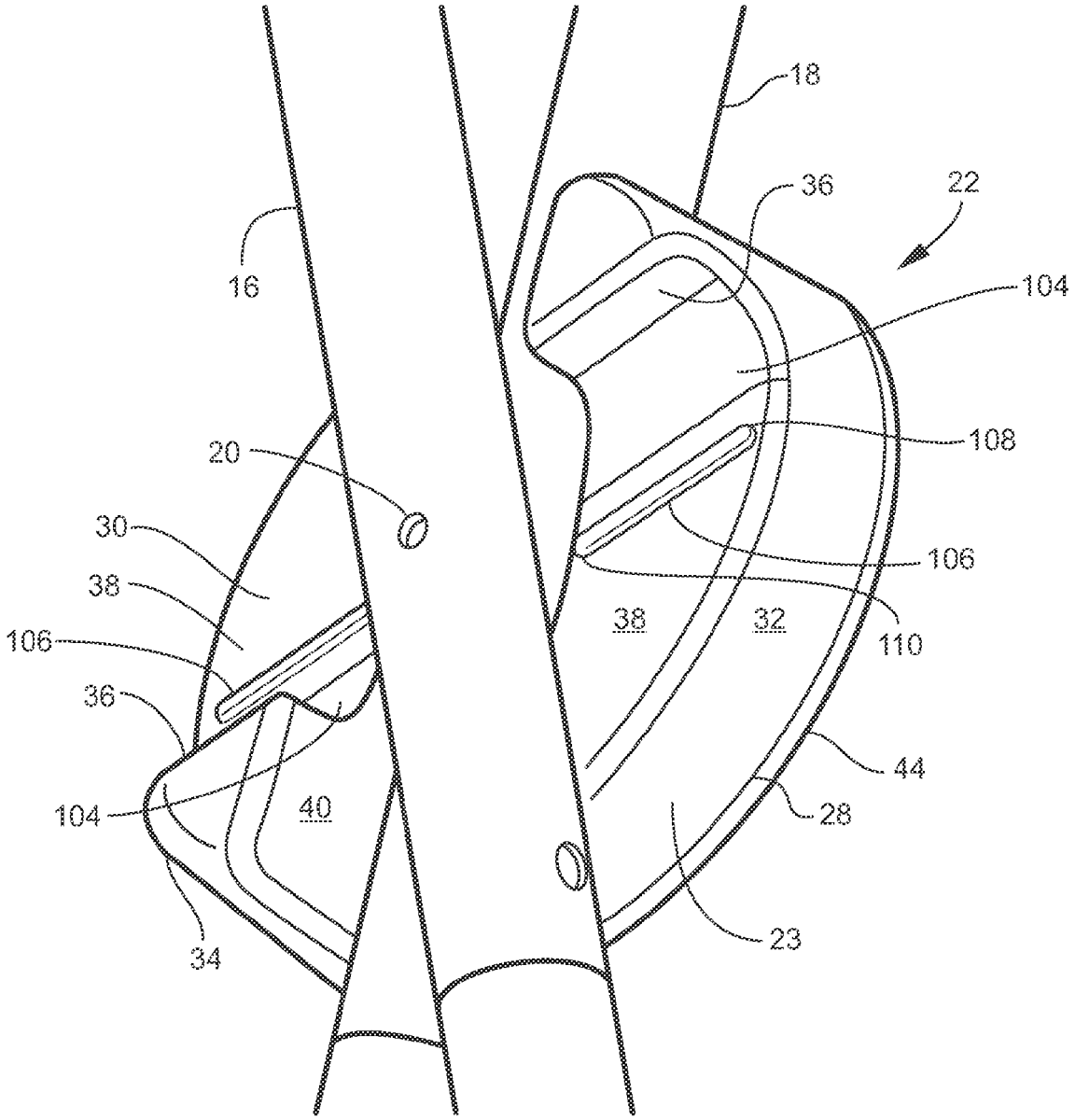
FIG. 11 is a perspective detail view of the pivot housing of the present infant bather, where the infant bather is in the closed configuration of FIG. 10.

FIG. 11 shows a detail view of the pivot housing 22 where the infant bather 10 is in the closed configuration of FIG. 10. FIG. 11 shows that main body 23 of the pivot housing 22 includes a pair of seats 104 into which support member 16 snaps (or into which support member 18 snaps in the opposite pivot housing 22) when frame 12 is opened to the open configuration of FIG. 1 and out of which support member 16 snaps (or out of which support member 18 snaps in the opposite pivot housing 22) when the frame 12 is closing out of the open configuration to the closed configuration of FIG. 10. Seat 104 is defined by face 36 on one side and by a ridge 106 on the other side and by a portion of rear face 38 running between face 36 and ridge 106. Ridge 106 is a protrusion from rear face 38 and includes an outer end 108 and an inner end 110. Ridge 106 runs straight between the ends 108, 110. Outer end 108 confronts sidewall 32. Inner end 110 confronts channel 24. Seat 104 runs radially from channel 24 to sidewall 32. Seats 104 are diametrically opposite of each other on one hub 23. Seat 104 is curved in the circumferential direction of hub 23 or cylindrical at the junction between the flat or right angle portion of face 36 and inner face 38 so as to mate with cylindrical support member 16 (or cylindrical support member 18 on the opposite pivot housing 22). When support member 16 (or 18) is rotated from the closed configuration of FIG. 10 toward the open configuration of FIG. 1, support member 16 (or 18) is rotating (or swinging or pivoting) in a first plane. When support member 16 (or 18) makes contact with ridge 106, support member 16 momentarily pops out of the first plane and moves inwardly toward the opposite pivot housing 22. When support member 16 (or 18) is further rotated over the ridge 106, support member 16 (or 18) pops back into the first plane and pops into seat 104. Seat 104 and its cooperating ridge 106 work as a stop to minimize unintended closing of the frame 12 from the open configuration of FIG. 1 to the closed configuration of FIG. 10, whereas face 36 works as a stop in the other direction of rotation to minimize unintended further opening of the frame 12 from the open configuration of FIG. 1. It should be noted that each of the main bodies 23 of pivot housing 22 includes a pair of seats 104 such that each of the main bodies 23 of pivot housing 22 includes a pair of ridges 106. Ridge 106 runs parallel to its respective cooperating face 36, and ridge 106 and face 36 run parallel to support member 16 (or 18) when the support member 16 (or 18) is in seat 104.

In operation, starting from the closed configuration shown in FIG. 10, the upper sections 46 are pulled apart from each other until members 16, 18 pop over ridges 106 and into seats 104 such that the stops 34 prevent the support members 16, 18 from rotating further. More specifically, the ridges 106, seats 104, and stops 34 of one pivot housing 22 catch the upper section 46 and lower section 48 of one support member 16 or 18 and the ridges 106, seats 104 and stops 34 of the other pivot housing 22 catch the upper section 46 and lower section 48 of the other support member 16, 18. Still more specifically, one seat 104 catches the upper section 46 and the other seat 104 of the same pivot housing 22 catches the lower section 48. When the seats 104 are engaged, the infant bather 10 is in the open position shown in FIG. 1. Seat 104 can be defined as including stop face 36 and ridge 106.

As the seats 104 are engaged by the support members 16, 18, the flexible infant bath 14 also may act as a stop to prevent further expansion of the frame 12. That is, the flexible infant bath 14 may be manufactured such that the unengaged edges 70, 72 draw tightly against the upper sections 46 at about the time the seats 104 or the stops 34 are engaged.

In the open configuration as shown in FIG. 1, the infant bather 10 is sufficiently light, is sufficiently narrow, and has a sufficiently small height to be placed under a faucet in a sink or bathtub to be filled with water. Then the infant bather 10 may be placed on a level surface. As an alternative to being placed under a faucet, infant bather 10 may first be placed on a surface, such as a level surface, and then water is poured into the infant bather. Whether the infant bath 14 is empty, is in the process of being filled with water, is full of water, or is cradling an infant, feet 64 minimize a slipping of the infant bather 10.

An infant may be placed into the infant bath 14 when the bath 14 is empty of water, when the infant bath 14 is partially full, or when the infant bath 14 is generally full or contains the amount of water desired by the caretaker. For example, for a sponge bath, an infant may be placed into a dry infant bath 14, whereupon during the sponge bath, the leakproof infant bath 14 holds water running off the infant.

When an infant is in the infant bath 14, the back of the infant rests on the back section 78, the butt of the infant rests on the butt section 82, and the legs of the infant rest on the leg section 80. The head of the infant is cradled on and in the head rest 90. The head of the infant may turn to the right or left side, whereupon the head is supported by one of the head support portions 98.

When an infant is in the infant bath 14, the weight of the infant and the weight of the water provide a downward force that may tend to push the upper sections 46 apart from each other. Working against such a force are the stops 34, the unengaged edges 70, 72 of the bath 14, and the nonslip feet 64.

When the caregiver has completed bathing the infant, the infant may be lifted from the bath 14. Then the infant may be handed to another caregiver or carried to a safe place such as a crib or baby seat. Then the bath 14 may be carried to a bathtub or sink and lifted at an angle to pour water from the bath 14 to the bathtub or sink. Then the bath 14 may be cleaned such as with a cleaning liquid to wash dirt, soap, and bodily wastes off the inside (and outside) of the bath 14. Then, by drawing the upper sections 46 of the support members 16, 18 toward each other, the frame 12 may be collapsed into the closed configuration shown in FIG. 10.

The frame 12 includes a first pivot housing 22 adjacent the head end 13 of the infant bather 10 and a second pivot housing 22 adjacent the foot end 15 of the infant bather 10. The pivot housings 22 engage the first and second support members 16, 18. At one of the pivot housings 22 the first support member 16 is disposed inwardly of the second support member 18, and wherein at the other of the pivot housings 22 the second support member 18 is disposed inwardly of the first support member 16.

The inclination along the back section 78 continually increases from the butt section 82 to the head end 13. The inclination along the leg section 80 continually increases from the butt section 82 to the foot end 15.

The flexible water bath 14 includes the perimeter 67 and first and second bath ends. The upper sections 46 of the first and second support members 16, 18 engage respective side portions of the perimeter 67 to open and close the flexible water bath 14. The upper sections 46 of the first and second support members 16, 18 are spaced apart from each other at a greater distance at the first bath end than at the second bath end such that the respective side portions of the perimeter 67 of the flexible water bath 14 are spaced apart from each other at a greater distance at the first bath end than at the second bath end. The flexible water bath 14 includes a pair of unengaged free edges 70, 72. One of the unengaged free edges 70, 72 is adjacent to the head end 13 of the infant bather 10 and runs from one respective side portion of the perimeter 67 to the other respective side portion of the perimeter 67, and the other of the unengaged free edges 70, 72 is adjacent to the foot end 15 of the infant bather 10 and runs from one respective side portion of the perimeter 67 to the other respective side portion of the perimeter 67.

Each of the lower sections 48 includes a horizontally running portion 56 having an undersurface. The flexible water bath 14 includes an underside 84 having a bottom-most section. The bottom-most section of the underside 84 of the flexible water bath 14 is disposed above the undersurfaces of the horizontally running portions 56 of the lower sections 48 of the first and second support members 16, 18. The bottom-most section of the underside 84 of the flexible water bath 14 is disposed below each of the first and second pivot housings 22.

An inclination of the leg section 80 is defined by an inclination of a straight line from a bottom-most section of the underside 84 to a top-most section of the underside of the leg section 80. An inclination of the back section 78 is defined by an inclination of a straight line from the bottom-most section of the underside 84 to a top-most section of the underside 84 of the back section 78. An inclination along the underside 84 of the back section 78 continually increases from the butt section 82 to the head end 13. An inclination along the underside 84 of the leg section 80 continually increases from the butt section 82 to the foot end 15.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. An infant bather having a head end and a foot end, comprising:

a) a frame having an open configuration and a closed configuration, the frame having a first support member and a second support member, the first support member being pivotally engaged to the second support member such that the first and second support members pivot relative to each other to open the frame from the closed configuration and to close the frame from the open configuration;

b) a flexible water bath engaged to the frame, the flexible water bath being watertight, the flexible water bath folding closed when the frame is closed from the open configuration to the closed configuration, the flexible water bath folding open when the frame is opened from the closed configuration to the open configuration;

c) wherein each of the first and second support members comprise first and second endless elongate support members, respectively, such that each of the first and second support members defines respective first and second endless loops, wherein the first endless support member passes through the second endless loop, and wherein the second endless support member passes through the first endless loop;

d) wherein the frame comprises a first pivot housing adjacent the head end of the infant bather and a second pivot housing adjacent the foot end of the infant bather, wherein said pivot housings engage the first and second support members, wherein at one of the pivot housings the first support member is disposed inwardly of the second support member, and wherein at the other of the pivot housings the second support member is disposed inwardly of the first support member;

e) wherein each of the first and second support members comprises upper and lower sections, wherein in the open configuration the upper section of the first support member confronts the lower section of the second support member and the lower section of the first support member confronts the upper section of the second support member, and wherein in the closed configuration the upper sections of the first and second support members confront each other and the lower sections of the first and second support members confront each other;

f) said first pivot housing comprising a first pivot block;

g) said second pivot housing comprising a second pivot block;

h) said first pivot block having a first channel running diametrically therethrough, said first channel receiving said first support member;

i) said second pivot block having a second channel running diametrically therethrough, said second channel receiving said second support member;

j) said first pivot block having a pair of first stops, each of the first stops projecting transversely of the second support member to stop the second support member from rotating in one direction, said first stops being positioned diametrically opposite each other; and k) said second pivot block having a pair of second stops, each of the second stops projecting transversely of the first support member to stop the first support member from rotating in one direction, said second stops being positioned diametrically opposite each other.

2. The infant bather of claim 1, wherein the flexible water bath comprises one or more of a polyamide, a nylon, and a ripstop nylon.

3. The infant bather of claim 1, wherein:

a) the flexible water bath includes a perimeter and first and second bath ends, wherein the upper sections of the first and second support members engage respective side portions of said perimeter to open and close the flexible water bath, and wherein the upper sections of the first and second support members are spaced apart from each other at a greater distance at the first bath end than at the second bath end such that said respective side portions of said perimeter of said flexible water bath are spaced apart from each other at a greater distance at the first bath end than at the second bath end; and b) wherein the flexible water bath includes a pair of unengaged free edges, one of the unengaged free edges being adjacent to the head end of the infant bather and running from one respective side portion of said perimeter to the other respective side portion of said perimeter, and the other of the unengaged free edges being adjacent to the foot end of the infant bather and running from one respective side portion of said perimeter to the other respective side portion of said perimeter.

4. The infant bather of claim 1, wherein one pivot housing nonrotatably engages the first support member and pivotally engages the second support member, and wherein the other of the pivot housings nonrotatably engages the second support member and pivotally engages the first support member.

5. The infant bather of claim 1, wherein each of the lower sections comprises a foot for supporting the infant bather on a surface, with the foot having a longitudinal channel therein into which said lower section is set.

6. The infant bather of claim 1, wherein each of the lower sections includes a horizontally running portion having an undersurface, wherein the flexible water bath includes an underside having a bottom-most section, wherein the bottom-most section of the underside of the flexible water bath is disposed above the undersurfaces of the horizontally running portions of the lower sections of the first and second support members, and wherein the bottom-most section of the underside of the flexible water bath is disposed below each of the first and second pivot housings.

7. An infant bather having a head end and a foot end, comprising:

a) a first support member having an upper section and a lower section, the first support member being elongate;

b) a second support member having an upper section and a lower section, the second support member being elongate, the second support member being pivotally engaged to the first support member at each of the head end and foot end of the infant bather;

c) a flexible water bath engaged between the upper section of the first support member and the upper section of the second support member, the flexible water bath folding out to an open configuration when the first and second support members are pivoted one way, and the flexible water bath folding in to a closed configuration when the first and second support members are pivoted the other way;

d) wherein the frame comprises a first pivot housing adjacent the head end of the infant bather and a second pivot housing adjacent the foot end of the infant bather, wherein said pivot housings engage the first and second support members, wherein one pivot housing nonrotatably engages the first support member and pivotally engages the second support member, and wherein the other of the pivot housings nonrotatably engages the second support member and pivotally engages the first support member;

e) said first pivot housing comprising a first pivot block;

f) said second pivot housing comprising a second pivot block;

g) said first pivot block having a first channel running diametrically therethrough, said first channel receiving said first support member;

h) said second pivot block having a second channel running diametrically therethrough, said second channel receiving said second support member;

i) said first pivot block having a pair of first stops, each of the first stops projecting transversely of the second support member to stop the second support member from rotating in one direction, said first stops being positioned diametrically opposite each other; and j) said second pivot block having a pair of second stops, each of the second stops projecting transversely of the first support member to stop the first support member from rotating in one direction, said second stops being positioned diametrically opposite each other.

8. The infant bather of claim 7, wherein each of the first and second support members is endless, wherein each of the first and second support members defines respective first and second loops, wherein the first loop passes through the second loop, and wherein the second loop passes through the first loop.

9. An infant bather having a head end and a foot end, comprising:

a) a frame having an open configuration and a closed configuration, the frame having a first support member and a second support member, the first support member being pivotally engaged to the second support member such that the first and second support members pivot relative to each other to open the frame from the closed configuration and to close the frame from the open configuration;

b) a flexible water bath engaged to the frame, the flexible water bath being watertight, the flexible water bath folding closed when the frame is closed from the open configuration to the closed configuration, the flexible water bath folding open when the frame is opened from the closed configuration to the open configuration;

c) wherein each of the first and second support members comprise first and second endless elongate support members, respectively, such that each of the first and second support members defines respective first and second endless loops, wherein the first endless support member passes through the second endless loop, and wherein the second endless support member passes through the first endless loop;

d) wherein the frame comprises a first pivot housing adjacent the head end of the infant bather and a second pivot housing adjacent the foot end of the infant bather, wherein said pivot housings engage the first and second support members, wherein at one of the pivot housings the first support member is disposed inwardly of the second support member, and wherein at the other of the pivot housings the second support member is disposed inwardly of the first support member;

e) wherein each of the first and second support members comprises upper and lower sections, wherein in the open configuration the upper section of the first support member confronts the lower section of the second support member and the lower section of the first support member confronts the upper section of the second support member, and wherein in the closed configuration the upper sections of the first and second support members confront each other and the lower sections of the first and second support members confront each other;

f) said first pivot housing comprising a first pivot block;

g) said second pivot housing comprising a second pivot block;

h) said first pivot block having a first channel running diametrically therethrough, said first channel receiving said first support member;

i) said second pivot block having a second channel running diametrically therethrough, said second channel receiving said second support member;

j) said first pivot block having a pair of first seats, each of the first seats running radially in said first pivot block, said first seats being diametrically opposite of each other, each of said first seats seating said second support member when said frame is in said open configuration; and k) said second pivot block having a pair of second seats, each of the second seats running radially in said second pivot block, said second seats being diametrically opposite of each other, each of the second seats seating said first support member when said frame is in said open configuration.

10. An infant bather having a head end and a foot end, comprising:

a) a frame having an open configuration and a closed configuration, the frame having a first support member and a second support member, the first support member being pivotally engaged to the second support member such that the first and second support members pivot relative to each other to open the frame from the closed configuration and to close the frame from the open configuration;

b) a flexible water bath engaged to the frame, the flexible water bath being watertight, the flexible water bath folding closed when the frame is closed from the open configuration to the closed configuration, the flexible water bath folding open when the frame is opened from the closed configuration to the open configuration;

c) wherein each of the first and second support members comprise first and second endless elongate support members, respectively, such that each of the first and second support members defines respective first and second endless loops, wherein the first endless support member passes through the second endless loop, and wherein the second endless support member passes through the first endless loop;

d) wherein the frame comprises a first pivot housing adjacent the head end of the infant bather and a second pivot housing adjacent the foot end of the infant bather, wherein said pivot housings engage the first and second support members, wherein at one of the pivot housings the first support member is disposed inwardly of the second support member, and wherein at the other of the pivot housings the second support member is disposed inwardly of the first support member;

e) wherein each of the first and second support members comprises upper and lower sections, wherein in the open configuration the upper section of the first support member confronts the lower section of the second support member and the lower section of the first support member confronts the upper section of the second support member, and wherein in the closed configuration the upper sections of the first and second support members confront each other and the lower sections of the first and second support members confront each other;

f) said first pivot housing comprising a first pivot block having a first sidewall and a first face;

g) said second pivot housing comprising a second pivot block having a second sidewall and a second face;

h) said first pivot block having a first channel running diametrically therethrough, said first channel receiving said first support member;

i) said second pivot block having a second channel running diametrically therethrough, said second channel receiving said second support member;

j) said first pivot block having a pair of first ridges, each of the first ridges having two first ridge ends, one first ridge end confronting said first channel, the other first ridge end confronting the first sidewall of said first pivot block, said first ridge running parallel to said second support member when said frame is in said open configuration, said first ridge being a protrusion relative to said first face, said second support member popping into and out of a first plane when said second support member is rotated over said first ridge, said first ridge working as a first stop to minimize unintended closing of said frame from said open configuration; and k) said second pivot block having a pair of second ridges, each of the second ridges having two second ridge ends, one second ridge end confronting said second channel, the other second ridge end confronting the second sidewall of said second pivot block, said second ridge running parallel to said first support member when said frame is in said open configuration, said second ridge being a protrusion relative to said second face, said first support member popping into and out of a second plane when said first support member is rotated over said second ridge, said second ridge working as a second stop to minimize unintended closing of said frame from said open configuration.

11. An infant bather having a head end and a foot end, comprising:

a) a frame having an open configuration and a closed configuration, the frame having a first support member and a second support member, the first support member being pivotally engaged to the second support member such that the first and second support members pivot relative to each other to open the frame from the closed configuration and to close the frame from the open configuration;

b) a flexible water bath engaged to the frame, the flexible water bath being watertight, the flexible water bath folding closed when the frame is closed from the open configuration to the closed configuration, the flexible water bath folding open when the frame is opened from the closed configuration to the open configuration;

c) wherein each of the first and second support members comprise first and second endless elongate support members, respectively, such that each of the first and second support members defines respective first and second endless loops, wherein the first endless support member passes through the second endless loop, and wherein the second endless support member passes through the first endless loop;

d) wherein the frame comprises a first pivot housing adjacent the head end of the infant bather and a second pivot housing adjacent the foot end of the infant bather, wherein said pivot housings engage the first and second support members, wherein at one of the pivot housings the first support member is disposed inwardly of the second support member, and wherein at the other of the pivot housings the second support member is disposed inwardly of the first support member;

e) wherein each of the first and second support members comprises upper and lower sections, wherein in the open configuration the upper section of the first support member confronts the lower section of the second support member and the lower section of the first support member confronts the upper section of the second support member, and wherein in the closed configuration the upper sections of the first and second support members confront each other and the lower sections of the first and second support members confront each other;

f) said first pivot housing comprising a first pivot block;

g) said second pivot housing comprising a second pivot block;

h) said first pivot block having a first channel running diametrically therethrough, said first channel receiving said first support member;

i) said second pivot block having a second channel running diametrically therethrough, said second channel receiving said second support member;

j) said first pivot block having a pair of first seats, a pair of first stops, and a pair of first ridges, each of the first seats being defined on one side by a face of said first stop, each of said first seats being defined on the other side by one of said first ridges, said first seats seating the second support member, said first stops minimizing unintended further opening of said frame from said open configuration, said first ridges minimizing unintended closing of said frame from said open configuration; and k) said second pivot block having a pair of second seats, a pair of second stops, and a pair of second ridges, each of the second seats being defined on one side by a face of said second stop, each of said second seats being defined on the other side by one of said second ridges, said second seats seating the first support member, said second stops minimizing unintended further opening of said frame from said open configuration, said first ridges minimizing unintended closing of said frame from said open configuration.

12. An infant bather having a head end and a foot end, comprising:

a) a first support member having an upper section and a lower section, the first support member being elongate;

b) a second support member having an upper section and a lower section, the second support member being elongate, the second support member being pivotally engaged to the first support member at each of the head end and foot end of the infant bather;

c) a flexible water bath engaged between the upper section of the first support member and the upper section of the second support member, the flexible water bath folding out to an open configuration when the first and second support members are pivoted one way, and the flexible water bath folding in to a closed configuration when the first and second support members are pivoted the other way;

d) wherein the frame comprises a first pivot housing adjacent the head end of the infant bather and a second pivot housing adjacent the foot end of the infant bather, wherein said pivot housings engage the first and second support members, wherein one pivot housing nonrotatably engages the first support member and pivotally engages the second support member, and wherein the other of the pivot housings nonrotatably engages the second support member and pivotally engages the first support member;

e) said first pivot housing comprising a first pivot block;

f) said second pivot housing comprising a second pivot block;

g) said first pivot block having a first channel running diametrically therethrough, said first channel receiving said first support member;

h) said second pivot block having a second channel running diametrically therethrough, said second channel receiving said second support member;

i) said first pivot block having a pair of first seats, each of the first seats running radially in said first pivot block, said first seats being diametrically opposite of each other, each of said first seats seating said second support member when said frame is in said open configuration; and j) said second pivot block having a pair of second seats, each of the second seats running radially in said second pivot block, said second seats being diametrically opposite of each other, each of the second seats seating said first support member when said frame is in said open configuration.

13. An infant bather having a head end and a foot end, comprising:

a) a first support member having an upper section and a lower section, the first support member being elongate;

b) a second support member having an upper section and a lower section, the second support member being elongate, the second support member being pivotally engaged to the first support member at each of the head end and foot end of the infant bather;

c) a flexible water bath engaged between the upper section of the first support member and the upper section of the second support member, the flexible water bath folding out to an open configuration when the first and second support members are pivoted one way, and the flexible water bath folding in to a closed configuration when the first and second support members are pivoted the other way;

d) wherein the frame comprises a first pivot housing adjacent the head end of the infant bather and a second pivot housing adjacent the foot end of the infant bather, wherein said pivot housings engage the first and second support members, wherein one pivot housing nonrotatably engages the first support member and pivotally engages the second support member, and wherein the other of the pivot housings nonrotatably engages the second support member and pivotally engages the first support member;

e) said first pivot housing comprising a first pivot block having a first sidewall and a first face;

f) said second pivot housing comprising a second pivot block having a second sidewall and a second face;

g) said first pivot block having a first channel running diametrically therethrough, said first channel receiving said first support member;

h) said second pivot block having a second channel running diametrically therethrough, said second channel receiving said second support member;

i) said first pivot block having a pair of first ridges, each of the first ridges having two first ridge ends, one first ridge end confronting said first channel, the other first ridge end confronting the first sidewall of said first pivot block, said first ridge running parallel to said second support member when said frame is in said open configuration, said first ridge being a protrusion relative to said first face, said second support member popping into and out of a first plane when said second support member is rotated over said first ridge, said first ridge working as a first stop to minimize unintended closing of said frame from said open configuration; and j) said second pivot block having a pair of second ridges, each of the second ridges having two second ridge ends, one second ridge end confronting said second channel, the other second ridge end confronting the second sidewall of said second pivot block, said second ridge running parallel to said first support member when said frame is in said open configuration, said second ridge being a protrusion relative to said second face, said first support member popping into and out of a second plane when said first support member is rotated over said second ridge, said second ridge working as a second stop to minimize unintended closing of said frame from said open configuration.

14. An infant bather having a head end and a foot end, comprising:

a) a first support member having an upper section and a lower section, the first support member being elongate;

b) a second support member having an upper section and a lower section, the second support member being elongate, the second support member being pivotally engaged to the first support member at each of the head end and foot end of the infant bather;

c) a flexible water bath engaged between the upper section of the first support member and the upper section of the second support member, the flexible water bath folding out to an open configuration when the first and second support members are pivoted one way, and the flexible water bath folding in to a closed configuration when the first and second support members are pivoted the other way;

d) wherein the frame comprises a first pivot housing adjacent the head end of the infant bather and a second pivot housing adjacent the foot end of the infant bather, wherein said pivot housings engage the first and second support members, wherein one pivot housing nonrotatably engages the first support member and pivotally engages the second support member, and wherein the other of the pivot housings nonrotatably engages the second support member and pivotally engages the first support member;

e) said first pivot housing comprising a first pivot block;

f) said second pivot housing comprising a second pivot block;

g) said first pivot block having a first channel running diametrically therethrough, said first channel receiving said first support member;

h) said second pivot block having a second channel running diametrically therethrough, said second channel receiving said second support member;

i) said first pivot block having a pair of first seats, a pair of first stops, and a pair of first ridges, each of the first seats being defined on one side by a face of said first stop, each of said first seats being defined on the other side by one of said first ridges, said first seats seating the second support member, said first stops minimizing unintended further opening of said frame from said open configuration, said first ridges minimizing unintended closing of said frame from said open configuration; and j) said second pivot block having a pair of second seats, a pair of second stops, and a pair of second ridges, each of the second seats being defined on one side by a face of said second stop, each of said second seats being defined on the other side by one of said second ridges, said second seats seating the first support member, said second stops minimizing unintended further opening of said frame from said open configuration, said first ridges minimizing unintended closing of said frame from said open configuration.

* * * * *